US012479650B2

(12) United States Patent
Kim et al.

(10) Patent No.: US 12,479,650 B2
(45) Date of Patent: Nov. 25, 2025

(54) DISPENSING CONTAINER FOR SOLID CONTENTS

(71) Applicant: AMOREPACIFIC CORPORATION, Seoul (KR)

(72) Inventors: Hansu Kim, Yongin-si (KR); Myeongjin Goh, Yongin-si (KR); Minkyung Kwon, Yongin-si (KR); Heungsoo Baek, Yongin-si (KR); Keunyong Yang, Yongin-si (KR); Sungwon Yi, Yongin-si (KR); Seongmin Jeong, Yongin-si (KR)

(73) Assignee: Amorepacific Corporation, Seoul (KR)

( * ) Notice: Subject to any disclaimer, the term of this patent is extended or adjusted under 35 U.S.C. 154(b) by 118 days.

(21) Appl. No.: 18/356,599

(22) Filed: Jul. 21, 2023

(65) Prior Publication Data

US 2024/0034541 A1 Feb. 1, 2024

(30) Foreign Application Priority Data

Aug. 1, 2022 (KR) ..... 10-2022-0095469

(51) Int. Cl.
*B65D 83/04* (2006.01)

(52) U.S. Cl.
CPC .... *B65D 83/0409* (2013.01); *B65D 2583/049* (2013.01)

(58) Field of Classification Search
CPC ..... B65D 83/0409
See application file for complete search history.

(56) References Cited

U.S. PATENT DOCUMENTS

2013/0116818 A1* 5/2013 Hamilton ..... A61J 7/04 221/277
2017/0231871 A1* 8/2017 Aldasouqi ..... B65D 83/04 221/203

* cited by examiner

*Primary Examiner* — Gene O Crawford
*Assistant Examiner* — Ayodeji T Ojofeitimi
(74) *Attorney, Agent, or Firm* — Sughrue Mion, PLLC

(57) ABSTRACT

A container for dispensing solid contents is disclosed. The container includes: a housing configured to store a plurality of solid contents having a predetermined shape; a dispensing member having a dispensing opening from which the solid contents are dispensed; and a rotating member provided on the upper side of the dispensing member to allow relative rotation with the dispensing member and configured to move at least some of the plurality of solid contents to the dispensing opening.

8 Claims, 7 Drawing Sheets

【Fig. 1】
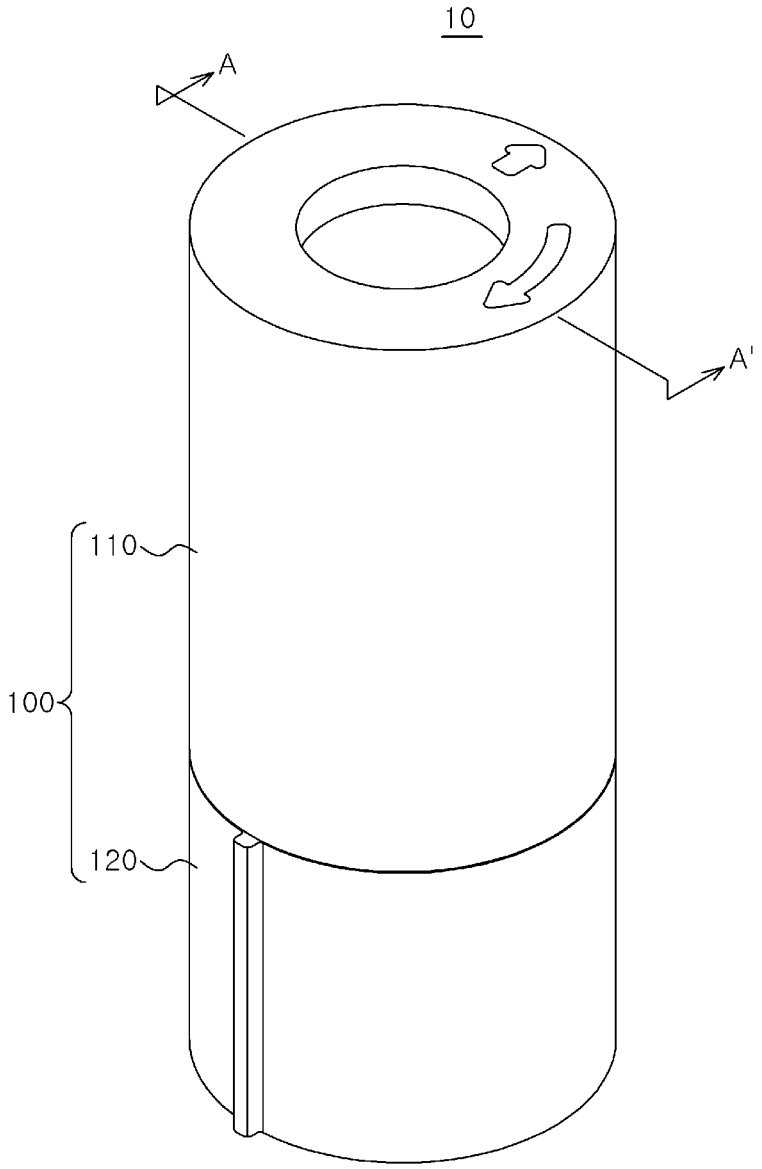

【Fig. 2】
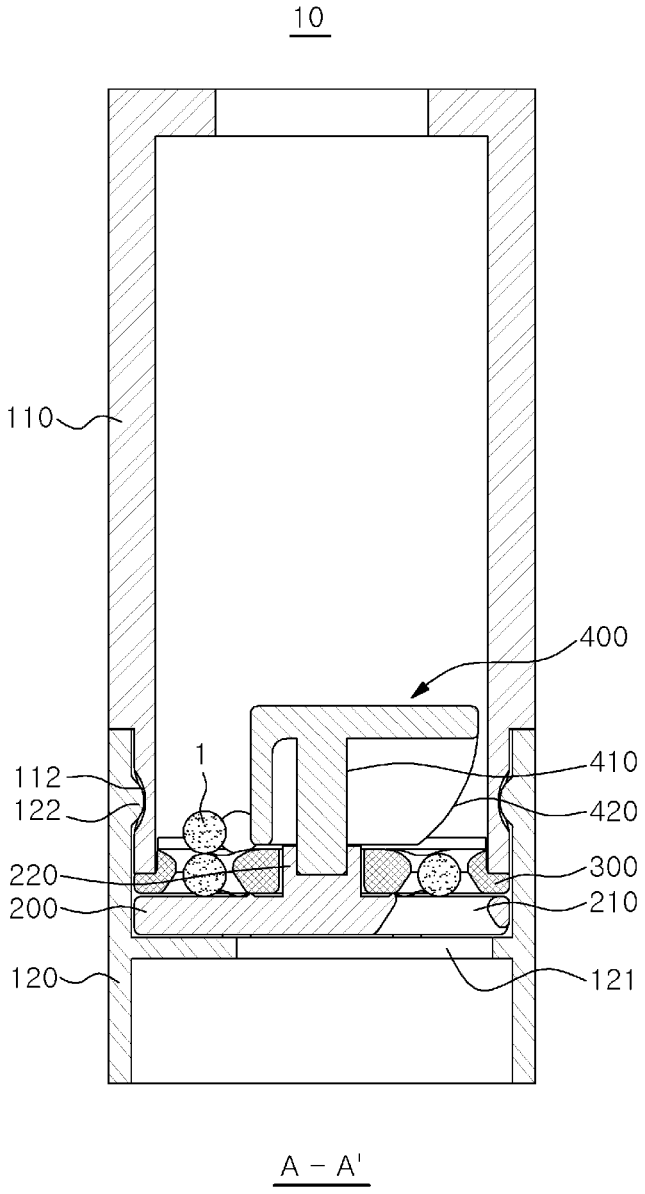

【Fig. 3】
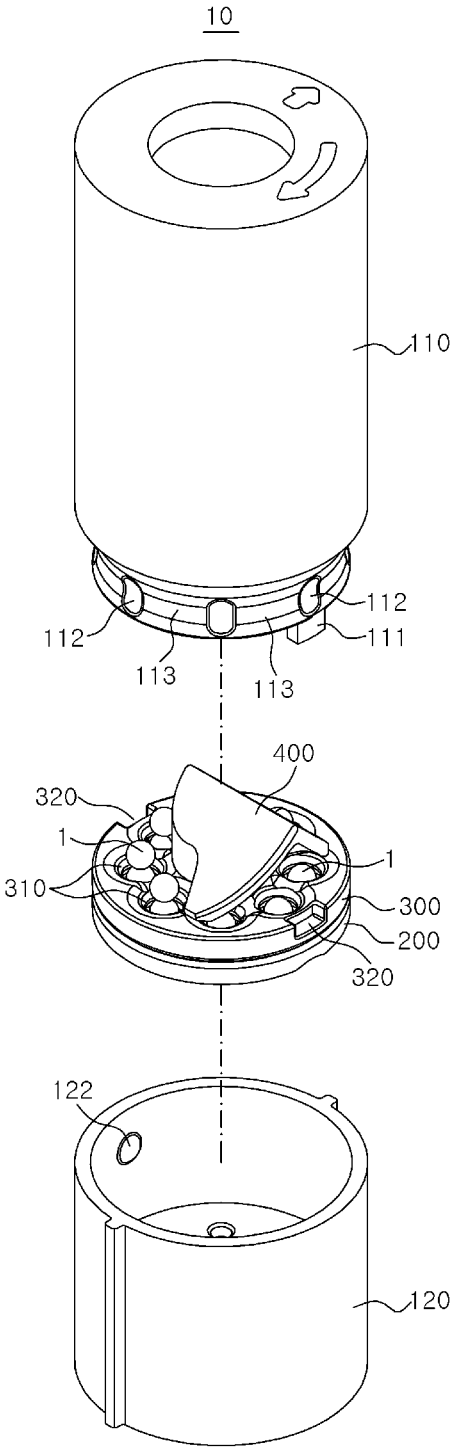

【Fig. 4】
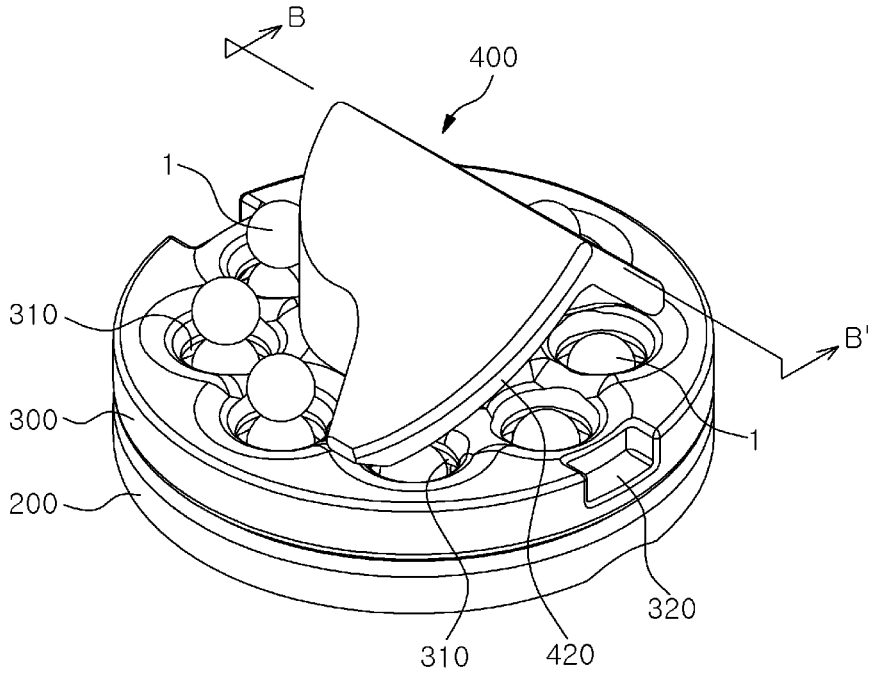

【Fig. 5】
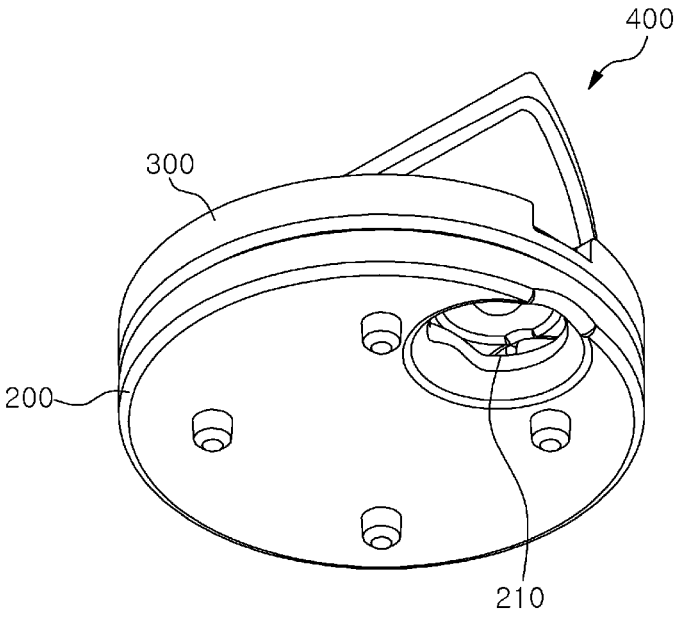

【Fig. 6】
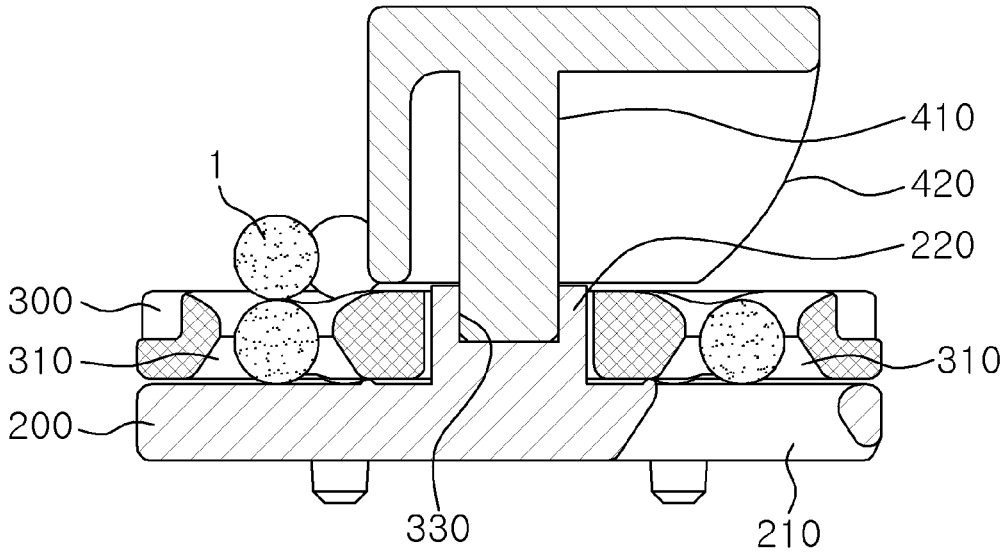
B – B'

【Fig. 7】
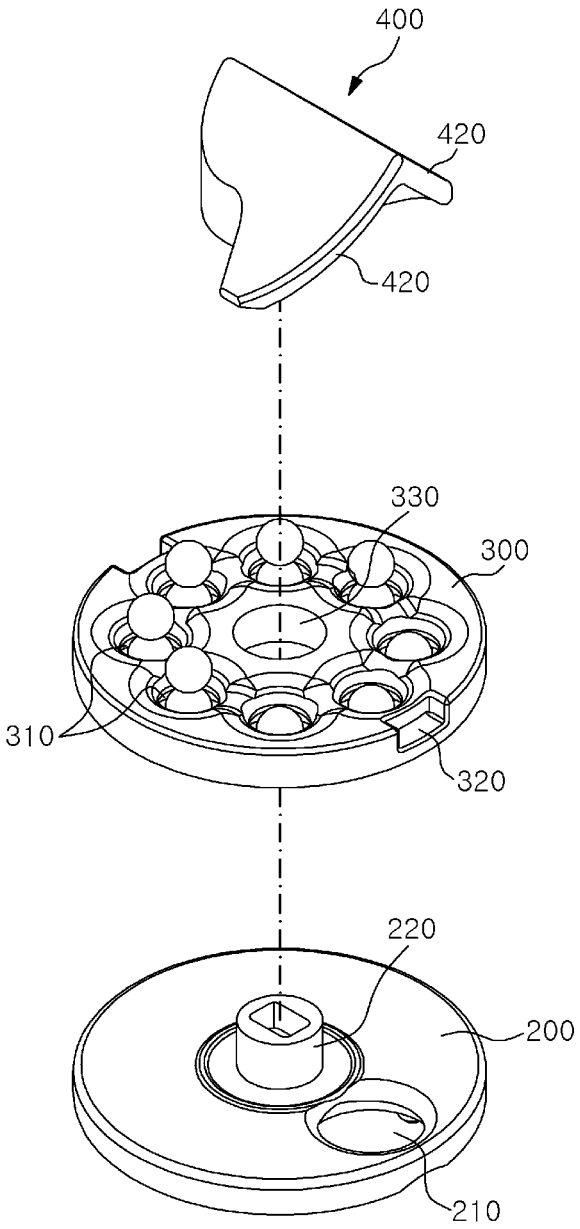

DISPENSING CONTAINER FOR SOLID CONTENTS

CROSS-REFERENCE TO RELATED APPLICATION(S)

This application is based on and claims priority of Korean Patent Application No. 10-2022-0095469, filed on Aug. 1, 2022 with the Korean Intellectual Property Office, the entire contents of which are hereby incorporated by reference.

TECHNICAL FIELD

The present disclosure relates to a container for dispensing solid contents.

BACKGROUND

Human skin is composed of an epidermal layer, a dermal layer, and a fat layer. A stratum corneum, the outermost layer of the epidermis, protects the skin, and lipids, which make up about 15% of the stratum corneum, are composed of ceramides, fatty acids, and cholesterol.

Of these, ceramides make up about 50% of the lipids and their function is to prevent moisture evaporation and maintain the ordered structure of the stratum corneum. Keratinocytes in the stratum corneum of the skin are firmly held together by ceramides, cholesterol, and free fatty acids, and skin cells have a higher content of ceramides and a higher content of non-polar, neutral ceramides compared to other cells in the human body. These are structural characteristics that are necessary for the skin to have a robust defense barrier.

In addition, the skin contains both moisture and oil, and an appropriate amount of oil component has a positive function of inhibiting moisture evaporation through the skin. The lipid layer in the skin's epidermis also acts as a barrier to moisture loss in the skin along with oil, and the main component of this lipid layer is ceramide.

When ceramides, the main component of intercellular lipids, are deficient, the formation of intercellular lipids does not work well, and when intercellular lipids are deficient, symptoms such as dry skin, dehydrated skin, eczema, rough skin, atopic skin, and accelerated skin aging appear.

Existing liquid cosmetic materials such as creams and lotions currently on the market have a very limited content due to the poor solubility of ceramide, and thus have a weak ability to inhibit moisture evaporation from the skin, which is not very helpful even though it is necessary to quickly restore the damaged skin barrier and improve skin wrinkles.

In addition, with liquid cosmetic materials, the dispensing amount is not precisely controlled, and it is difficult to accurately implement a desired color, which may cause color deviation.

Solid cosmetic materials, such as bead-type cosmetics, have been developed to overcome the above disadvantages of conventional liquid cosmetic materials.

The solid cosmetic materials have the advantage of containing a high content of ceramide because the outside thereof forms a wax layer and the inside thereof is in the form of an emulsion. The solid cosmetic materials are taken out and used one by one, and the cosmetic containers in which the solid cosmetic materials are received and stored are the same as the conventional liquid cosmetic containers, so there is an inconvenience of having to take out and use the solid cosmetics with tools such as tweezers.

Since the solid cosmetic materials have a soft wax surrounding the ceramides, when they are taken out and used by hand, other surrounding solid cosmetic materials may come into contact the fingers, resulting in crushing and breakage.

Therefore, the conventional storage containers for storing solid contents such as the solid cosmetic material have the inconvenience of requiring the use of tools such as the tweezers, and there is an inherent problem of losing the tweezers.

In addition, when the tweezers are not used, it may cause various problems such as contamination of the tweezers tools, which must be kept clean during use or storage, and the inconvenience of having to provide a separate storage space in the container.

SUMMARY

An embodiment of the present disclosure, which have been conceived to address the problems described above, is to provide a container for dispensing solid contents that facilitates the dispensing of the solid contents, wherein the dispensing amount can be readily adjustable and color deviation can be reduced.

Further, an embodiment of the present disclosure is to provide a container for dispensing solid contents which, when dispensing the solid contents from the container, accurately dispenses such contents without damaging other surrounding solid contents stored therein by preventing the other surrounding solid contents from being crushed or disturbed.

According to one aspect of the present disclosure, there may be provided a container for dispensing solid contents, which includes: a housing configured to store a plurality of solid contents having a predetermined shape; a dispensing member having a dispensing opening from which the solid contents are dispensed; and a rotating member provided on the upper side of the dispensing member to allow relative rotation with the dispensing member and configured to move at least some of the plurality of solid contents to the dispensing opening.

Further, there may be provided a container for dispensing solid contents, wherein the rotating member includes a plurality of seating holes configured to seat at least some of the plurality of solid contents stored in the housing and cause at least one or more of the seated solid contents to be moved to the dispensing opening.

Further, there may be provided a container for dispensing solid contents, wherein the seating holes are formed to pass through the rotating member and to be spaced apart from each other at regular intervals along the circumferential direction of the rotating member.

Further, there may be provided a container for dispensing solid contents, further comprising a stopper member configured to allow relative rotation with the rotating member on the upper side of the rotating member so that at least some of the plurality of solid contents stored in the housing are seated in the seating holes.

Further, there may be provided a container for dispensing solid contents, wherein the stopper member is detachably connected to the central portion of the dispensing member and is provided as one body with the discharge member.

Further, there may be provided a container for dispensing solid contents, wherein the dispensing member further includes a coupling boss portion protruding upwardly from the central portion thereof and configured to axially couple with the stopper member.

Further, there may be provided a container for dispensing solid contents, wherein the stopper member includes: a shaft part extending downward to be detachably coupled to the coupling boss portion; and a plurality of wing parts formed in the lower inclined direction approaching the rotating member from the upper portion and configured to flow the solid contents to be seated in the seating holes.

Further, there may be provided a container for dispensing solid contents, wherein the housing includes: an upper housing rotatably provided at the upper portion of the dispensing member and configured to rotate the dispensing member by transmitting a rotational force to the rotating member; and a lower housing surrounding and covering, in the lower portion of the dispensing member, the dispensing member, the rotating member, and a portion of a lower portion of the upper housing, and having an outlet formed in communication with the dispensing opening and configured to discharge the solid contents.

Further, there may be provided a container for dispensing solid contents, wherein the upper housing includes protrusions on the bottom portion thereof extending protrusively toward the rotating member and configured to transmit the rotational force to the rotating member; and the rotating member includes recesses into which the protrusions are inserted corresponding to the protrusions.

Further, there may be provided a container for dispensing solid contents, wherein the upper housing has a plurality of notch grooves that are recessed and spaced at regular intervals along the circumferential direction in a region overlapping the lower housing, and guide grooves configured to circumferentially connect the notch grooves; and the lower housing has a notch ball which is inserted into one of the notch grooves to provide the feeling of catching to the user.

According to an embodiment of the present disclosure, the container for dispensing solid contents has the effect of reducing color deviation because it is easy to adjust the dispensing amount of the solid contents and accurately implement the desired color.

According to an embodiment of the present disclosure, the container for dispensing solid contents may prevent damage to solid cosmetic materials because other solid contents stored therein are not touched by a user when the solid contents are dispensed.

BRIEF DESCRIPTION OF DRAWINGS

The above and other objects, features and advantages of this disclosure will become more apparent to those skilled in the art by describing exemplary embodiments thereof in detail with reference to the accompanying drawings, in which:

FIG. 1 is an exterior perspective view of a dispensing container according to one embodiment of the present disclosure;

FIG. 2 is a cross-sectional view of a line A-A' of FIG. 1;

FIG. 3 is an exploded perspective view of the housing shown in FIG. 1;

FIG. 4 is a perspective view illustrating a coupled state of a dispensing member, a rotating member, and a stopper member of the dispensing container according to one embodiment of the present disclosure;

FIG. 5 is a bottom perspective view of FIG. 4;

FIG. 6 is a cross-sectional view of a line B-B' of FIG. 4; and

FIG. 7 is an exploded perspective view of FIG. 4.

DETAILED DESCRIPTION OF EXEMPLARY EMBODIMENTS

Hereinafter, specific embodiments of the present disclosure will be described in detail with reference to the accompanying drawings. Additionally, it is noted that in the description of the present disclosure, the detailed description for known related configurations or functions may be omitted when it is deemed that such description may obscure essential points of the present disclosure.

Hereinafter, an embodiment of the present disclosure will be described with reference to the accompanying drawings.

FIG. 1 is an exterior perspective view of a dispensing container according to one embodiment of the present disclosure. FIG. 2 is a cross-sectional view of a line A-A' of FIG. 1. FIG. 3 is an exploded perspective view of the housing shown in FIG. 1. FIG. 4 is a perspective view illustrating a coupled state of a dispensing member, a rotating member, and a stopper member of the dispensing container according to one embodiment of the present disclosure FIG. 5 is a bottom perspective view of FIG. 4. FIG. 6 is a cross-sectional view of a line B-B' of FIG. 4. FIG. 7 is an exploded perspective view of FIG. 4.

Referring to FIGS. 1 to 3, a dispensing container 10 according to one embodiment of the present disclosure may include a housing 100, a dispensing member 200, and a rotating member 300, which may further include a stopper member 400.

The housing 100 is a component that forms the overall appearance of the dispensing container 10 according to the present embodiment, in which a plurality of solid contents 1 having a predetermined shape may be stored.

Here, the solid contents 1 may generally be provided in a spherical shape, such as a bead shape, but the solid contents 1 are not necessarily limited to the spherical shape and may be provided in any other predetermined shape. Further, the solid contents 1 may refer to any solid form of contents that can be stored and retained and dispensed, such as nutritional supplements or medicines that can be taken, in addition to the cosmetic materials that can be used as cosmetics.

The housing 100 is configured to allow a plurality of solid contents 1 to be stored and retained therein, and to allow the solid contents 1 stored therein to be extracted individually when required.

Specifically, as shown in FIG. 3, the housing 100 may include an upper housing 110 and a lower housing 120.

The upper housing 110 is rotatably provided on the upper portion of the dispensing member 200, so that a user can grasp the upper housing 110 by hand and rotate the upper housing 110. When the upper housing 110 is rotated by the user, the rotational force may transmitted to the rotating member 300, and in turn the rotating member 300 may also be rotated with the upper housing 110.

In order to transmit the rotational force of the upper housing 110 to the rotating member 300, a protrusion 111 may be provided on the bottom of the upper housing 110, which protrudes and extends toward the rotating member 300. The protrusion Ill may protrude downward from the bottom of the upper housing 110 by a predetermined length, and there may be one or more protrusions. In a case where two or more protrusions 111 are provided, a plurality of protrusions 111 may be arranged to be spaced apart from each other at predetermined intervals along the circumferential direction.

The protrusion 111 provided on the bottom of the upper housing 110 may be inserted into one side of the rotating member 300 to transmit a rotational force of the upper housing 110 to the rotating member 300, thereby rotating the rotating member 300.

In addition, the rotating member 300 may have a recess 320 formed therein for inserting the protrusion 111 at a position corresponding to the protrusion 111. The protrusion 111 of the upper housing 110 may be inserted into the recess 320, and when the upper housing 110 is rotated by a user, the protrusion 111 inserted into the recess 320 may transmit a rotational force in the circumferential direction to the rotating member 300, thereby rotating the rotating member 300.

In addition, the lower housing 120 may surround and cover the dispensing member 200, the rotating member 300, and a portion of a lower portion of the upper housing 110 from the lower portion of the dispensing member 200. In this case, the dispensing member 200 and the rotating member 300 may be accommodated in the lower housing 120, and if the stopper member 400 is further provided, the stopper member 400 may also be accommodated in the lower housing 120.

Further, the lower housing 120 is provided to allow relative rotation with the upper housing 110, such that when the upper housing 110 is rotated, the lower housing 120 is configured not to rotate.

The lower housing 120 may be coupled in a structure that overlaps a portion of the bottom of the upper housing 110.

The upper housing 110 has a plurality of notch grooves 112 that are formed at a region overlapping the lower housing 120 and are recessed at regular intervals along the circumferential direction. Further, the plurality of notch grooves 112 may be connected by guide grooves 113 extending along the circumferential direction. In this case, the notch grooves 112 may be formed deeper inside the upper housing 110 than the guide grooves 113.

A notch ball 122 may be formed in the lower housing 120 to be inserted into one of the notch grooves 112 to provide the feeling of catching for the user. The notch ball 122 is somewhat restrained from rotation in both directions when inserted into the notch groove 112, and it may be necessary to rotate the upper housing 110 with a force greater than this restraining force in order to separate the notch groove 112 from the notch ball 122. Continued rotation of the upper housing 110 causes the guide groove 113 to slide along the notch ball 122 and then insert the notch ball 122 into the other adjacent notch groove 112, which again exerts a certain restraining force on the upper housing 110 again, thereby providing the user with the feeling of being caught.

Here, the separation angle of the notch grooves 112 may be set to correspond to the separation angle of seating hole 310, which will be discussed later, and in this embodiment, the spacing angle of the notch grooves 112 is set to 45 degrees, but is not necessarily limited thereto, and may be appropriately changed as necessary.

In this way, when the user rotates the upper housing 110 by the spacing angle of the notch grooves 112 (45 degrees), the rotating member 300 may also rotate by the same angle, and the user may have a feeling of catching when the notch ball 122 is inserted into the notch grooves 112, and at the same time, the solid contents 1 seated in the seating hole 310, which will be discussed later, may be discharged to the outside through the dispensing opening 210.

In addition, the lower housing 120 may have an outlet 121 formed therein for discharging the solid contents 1 to the outside, as shown in FIG. 2.

The outlet 121 may be formed in communication with the dispensing opening 210 to allow the solid contents 1 that are dispensed to the outside of the dispensing member 200 through the dispensing opening 210 to be discharged to the outside of the housing 100 through the outlet 121. The outlet 121 may be formed at a location corresponding to the dispensing opening 210, and may be formed with a size equal to or larger than the dispensing opening 210.

Meanwhile, referring to FIGS. 4 to 7, the dispensing member 200 may be provided for dispensing the solid contents 1. The dispensing member 200 may be provided with the dispensing opening 210 through which the solid contents 1 may be dispensed.

The dispensing opening 210 may be formed in a size corresponding to the size of one solid content 1, and, if necessary, it may be formed in a size in which a plurality of solid contents 1 are dispensed at the same time when it is necessary to simultaneously dispense the plurality of solid contents 1.

Further, the rotating member 300 may be provided to be relatively rotatable with the discharging member 200 on the upper side of the discharging member 200. Further, the rotating member 300 may be provided to move at least some of the plurality of solid contents 1 stored in the upper housing 110 toward the dispensing opening 210 of the dispensing member 200.

The rotating member 300 may include a plurality of seating holes 310 for seating the plurality of solid contents 1 and sequentially moving at least one or more of the seated solid contents 1 to the dispensing opening 210 of the dispensing member 200.

The seating holes 310 may seat and accommodate at least some of the plurality of solid contents 1 stored in the housing 100, particularly the upper housing 110. Further, the seating holes 310 may cause at least one or more of the seated solid contents 1 to be moved sequentially to the dispensing opening 210 of the dispensing member 200. In this case, a plurality of seating holes 310 are formed passing through the rotating member 300 and may be formed to be spaced apart from each other at regular intervals along the circumferential direction of the rotating member 300. The separation angle of the seating holes 310 may be set to be the same as the separation angle of the notch grooves 112 of the upper housing 110, as described above.

As such, when the rotating member 300 is rotated while the solid contents 1 are accommodated in the seating holes 310 of the rotating member 300, the solid contents 1 accommodated in the seating holes 310 may be rotated along the circumferential direction at the upper portion of the dispensing member 200 by the rotating me giber 300 and may then be dispensed to the outside of the dispensing member 200 through the dispensing opening 210 when they reach the dispensing opening 210.

Meanwhile, the dispensing container 10 according to one embodiment of the present disclosure may further include the stopper member 400.

The stopper member 400 may be provided on the upper side of the rotating member 300 to enable relative rotation with the rotating member 300. In addition, the stopper member 400 may serve to help at least some of solid contents 1 among the plurality of solid contents 1 stored in the upper housing 110 of the housing 100 to be seated in the seating hole 310, so that the solid contents 1 can be easily accommodated in the seating hole 310.

That is, the stopper member 400 may push the plurality of solid contents 1 stored in the upper housing 110 in the circumferential direction by being rotated at the upper portion of the rotating member 300, so that the solid contents 1 can easily enter the seating holes 310.

In this case, the stopper member 400 may be connected to the rotating center portion of the dispensing member 200 and coupled with the dispensing member 200. Accordingly, as shown in FIGS. 6 and 7, a through hole 330 through which a portion of the stopper member 400 may penetrate may be formed in the rotating center portion of the rotating member 300, and a portion of the stopper member 400 (e.g., a shaft part) may be detachably coupled to the rotating center portion of the dispensing member 200 through the through hole 330.

In order for the stopper member 400 to be detachably coupled to the dispensing member 200 in this manner, the dispensing member 200 may include a coupling boss portion 220 protruding upwardly from the center thereof for axially coupling the stopper member 400.

The coupling boss portion 220 may be inserted into the through hole 330 of the rotating member 300 so as to be the center of rotation when the rotating member 300 is rotated. In this case, the dispensing opening 210 may be disposed eccentrically on one side thereof away from the coupling boss portion 220.

Further, the stopper member 400 may include the shaft part 410 and a wing part 420.

The shaft part 410 may extend downwardly by a predetermined length so as to be detachably coupled to the coupling boss portion 220. The shaft part 410 may be inserted into the coupling boss portion 220, and may have a triangular or square angular cross-section to prevent it from sliding out of the coupling boss portion 220 with the shaft part inserted therein, and may be formed with an oval cross-section.

In addition, the wing part 420 may be provided in such a manner that it pushes the solid content 1 to flow in the circumferential direction on the upper surface of the rotating member 300 so that the solid content 1 is seated in the seating hole 310. The wing part 420 may be formed in the lower inclined direction approaching the upper surface of the rotating member 300 from the upper portion thereof, and may be provided in plural to increase the flowability of the solid content 1

In the following, the action and operation of the dispensing container 10 according to one embodiment of the present disclosure will be briefly described.

In the dispensing container 10 shown in FIG. 1, a plurality of solid contents 1 are stored in the upper housing 110. In this state, the user may hold to fix the lower housing 120 by hand and rotate the upper housing 110.

When the upper housing 110 is rotated, any one of the notch grooves 112 that has been caught by the notch ball 122 of the lower housing 120 is separated from the notch ball 122, the guide groove 113 is inserted into the notch ball 122 that is rotating, and then the other adjacent notch groove 112 is caught by the notch ball 122, thereby providing the feeling of catching to the user.

As such, when the upper housing 110 is rotated, the rotating member 300 is rotated by the protrusion 111 of the upper housing 110. At this time, the rotating member 300 is rotated at the same rotation angle as the upper housing 110 so that the solid content 1 accommodated in the seating hole 310 reaches the dispensing opening 210, and the solid content 1 that reaches the dispensing opening 210 may be discharged to the outside while passing through the dispensing opening 210 and the outlet 121.

At the same time, as the rotating member 300 is rotated, the solid contents 1 stored in the upper housing 110 may be accommodated in the seating holes 310 by the wing part 420 of the stopper member 400. When the rotating member 300 is rotated, the solid contents 1 accommodated in any one of the seating holes 310 may be dispensed through the dispensing opening 210, and the wing part 420 may cause a new solid content 1 to be easily accommodated in an empty seating hole 310.

Here, the upper housing 110 and the rotating member 300 may move as one body, and the dispensing member 200 and the stopper member 400 may move as one body. Thus, the elements that are actually rotated are the upper housing 110 and the rotating member 300, and the elements that are fixed and immovable are the stopper member 400 and the dispensing member 200. However, since the dispensing member 200, the stopper member 400, and the rotating member 300 are provided in a configuration of relative rotation, although the dispensing member 200 and the stopper member 400 are actually fixed when the rotating member 300 is rotated, the solid contents 1 may be put into the seating holes 310 by the wing part 420 of the stopper member 400.

Meanwhile, the solid contents 1 dispensed through the dispensing opening 210 is discharged to the outside of the housing 100 through the outlet 121 of the lower housing 120, and the discharged solid content 1 is used by the user.

REFERENCE SIGNS LIST

1 solid contents
10: dispensing container
100: housing
110: upper housing
111: protrusions
112: notch grooves
113: guide grooves
120: lower housing
121: outlet
122: notch ball
200: dispensing member
210: dispensing opening
220: coupling boss
300: rotating member
310: seating holes
320: recesses
330: through holes
400: stopper member
410: shaft part
420: wing part

What is claimed is:

1. A container for dispensing solid contents comprising:

a housing configured to store a plurality of solid contents having a predetermined shape;

a dispensing member having a dispensing opening from which the solid contents are dispensed; and a rotating member provided on a upper side of the dispensing member to allow relative rotation with the dispensing member and configured to move at least some of the plurality of solid contents to the dispensing opening, wherein the rotating member includes:

a plurality of seating holes configured to seat at least some of the plurality of solid contents stored in the housing and cause at least one or more of the seated solid contents to be moved to the dispensing opening, wherein the container for dispensing solid contents further comprises:

a stopper member configured to allow relative rotation with the rotating member on the upper side of the rotating member so that at least some of the plurality of solid contents stored in the housing are seated in the seating holes, wherein the stopper member includes a plurality of wing parts formed in the lower inclined direction approaching the rotating member from the upper portion and configured to flow the solid contents to be seated in the seating holes.

2. The container of claim 1, wherein the seating holes are formed to pass through the rotating member and to be spaced apart from each other at regular intervals along the circumferential direction of the rotating member.

3. The container of claim 1, wherein the stopper member is detachably connected to the central portion of the dispensing member and is provided as one body with the dispensing member.

4. The container of claim 3, wherein the dispensing member further includes an coupling boss portion protruding upwardly from the central portion thereof and configured to axially couple with the stopper member.

5. The container of claim 4, wherein the stopper member further includes:

a shaft part extending downward to be detachably coupled to the coupling boss portion.

6. The container of claim 1, wherein the housing includes:

an upper housing rotatably provided at the upper portion of the dispensing member and configured to rotate the dispensing member by transmitting a rotational force to the rotating member; and a lower housing surrounding and covering, in a lower portion of the dispensing member, the rotating member, and a portion of a lower portion of the upper housing, and having an outlet formed in communication with the dispensing opening and configured to discharge the solid contents.

7. The container of claim 6, wherein the upper housing includes protrusions on the bottom portion thereof extending protrusively toward the rotating member and configured to transmit the rotational force to the rotating member; and the rotating member includes recesses into which the protrusions are inserted corresponding to the protrusions.

8. The container of claim 6, wherein the upper housing has a plurality of notch grooves that are recessed and spaced at regular intervals along the circumferential direction in a region overlapping the lower housing, and guide grooves configured to circumferentially connect the notch grooves; and the lower housing has a notch ball which is inserted into one of the notch grooves to provide the feeling of catching to the user.

* * * * *